US006757501B2

(12) United States Patent
Mochizuki et al.

(10) Patent No.: US 6,757,501 B2
(45) Date of Patent: Jun. 29, 2004

(54) MULTIFUNCTIONAL PRINTER AND COPIER

(75) Inventors: Yoichi Mochizuki, Tokyo (JP); Kimio Saito, Tokyo (JP)

(73) Assignee: Panasonic Communications Co., Ltd., Fukuoka (JP)

( * ) Notice: Subject to any disclaimer, the term of this patent is extended or adjusted under 35 U.S.C. 154(b) by 25 days.

(21) Appl. No.: 10/329,404

(22) Filed: Dec. 27, 2002

(65) Prior Publication Data

US 2003/0170036 A1 Sep. 11, 2003

(30) Foreign Application Priority Data

Mar. 8, 2002 (JP) ..... 2002-064117

(51) Int. Cl.[7] ..... G03G 15/00
(52) U.S. Cl. ..... 399/18; 399/21
(58) Field of Search ..... 399/16, 18, 21, 399/9, 75, 76, 81, 37, 88, 391; 271/145, 256, 258.01

(56) References Cited

U.S. PATENT DOCUMENTS 4,718,658 A * 1/1988 Hirose et al. ..... 399/16 X
5,034,780 A * 7/1991 Kotabe et al. ..... 399/21
5,480,131 A * 1/1996 Furukawa et al. ..... 271/145 X
5,761,567 A * 6/1998 Yoshizuka ..... 399/18 X
6,523,821 B2 * 2/2003 Kashiwagi et al. ..... 271/145

FOREIGN PATENT DOCUMENTS

JP 02-265825 * 10/1990

* cited by examiner

*Primary Examiner*—Sophia S. Chen
(74) *Attorney, Agent, or Firm*—Greenblum & Bernstein, P.L.C.

(57) ABSTRACT

A multifunctional printer is provided with an external LCT (Large Capacity Tray) that has an elevator movable in up/down directions, the elevator being empowered by a power supply to a drive mechanism of a body unit. Paper is provided on the elevator to be fed into the body unit. When a sheet of paper remains within the LCT during a paper delivery error, the elevator is lowered to a predetermined location before shutting down the power supply to the drive mechanism in the body unit.

12 Claims, 8 Drawing Sheets

MULTIFUNCTIONAL PRINTER AND COPIER

BACKGROUND OF THE INVENTION

1. Field of the Invention

The present invention relates to a multifunctional printer and a copier that have an external paper tray attached to an apparatus body.

2. Description of Related Art

In recent years, some types of multifunctional printers/copiers have an option of having an external paper tray to be attached to an external part of an apparatus body, in addition to internal paper trays provided inside of the body.

The external paper tray includes a built-in elevator on which paper is loaded. A cover of the external paper tray is opened in order to load paper in the external paper tray. Upon detecting the open cover, the elevator is automatically lowered at the lowest position so that there is enough space to load paper. When the paper is set on the elevator and the cover is closed, the closure of the cover is detected, thereby automatically raising the elevator up to a position where the top paper becomes feedable. Accordingly, the paper setting is completed. In addition, the elevating operation of the elevator is performed by a drive of the apparatus body.

However, the conventional technology had the following problem.

When the apparatus body is having an error during a paper feeding, no matter whether the paper from the internal paper tray or from the external paper tray is causing the problem, the power supply for the drive mechanism of the apparatus body is immediately shut down, for safety reasons.

Therefore, in case of having a paper delivery error in the external paper tray, the elevator does not become lowered, even when the cover of the external paper tray is opened to retrieve the jammed paper. Since there is little space between the top surface of the external paper tray and the top paper loaded on the elevator, it is impossible to reach for the paper, thereby making it difficult to retrieve the jammed paper.

SUMMARY OF THE INVENTION

This invention addresses the above-described problem. The purpose of the present invention is to provide a copier and a multifunctional printer that allows an easy removal of jammed paper while providing user safety, during a paper delivery error in the external paper tray.

In this invention, a multifunctional printer is provided with an external paper tray that has an elevator movable in up/down directions, the elevator being empowered by a power supply to a drive mechanism of an apparatus body. Paper is provided on the elevator to be fed into the apparatus body. When a sheet of paper remains within the external paper tray during a paper delivery error, the elevator is lowered to a predetermined location before shutting down the power supply to the drive mechanism in the apparatus body.

Accordingly, it is possible to provide safety by shutting down the power supply to the drive mechanism in the apparatus body in case of a paper delivery error. At the same time, the elevator is lowered to provide a space necessary for removing the paper jam. Since the user's hand can reach between the inner top wall of the external paper tray and the top sheet of the paper loaded on the elevator, it is possible to easily remove the paper jam.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

The embodiment of the present invention is explained in the following, in reference to the above-described drawings. In this specification, a multifunctional printer is defined as an apparatus that has printer, copier, and facsimile functions.

Figure 1:
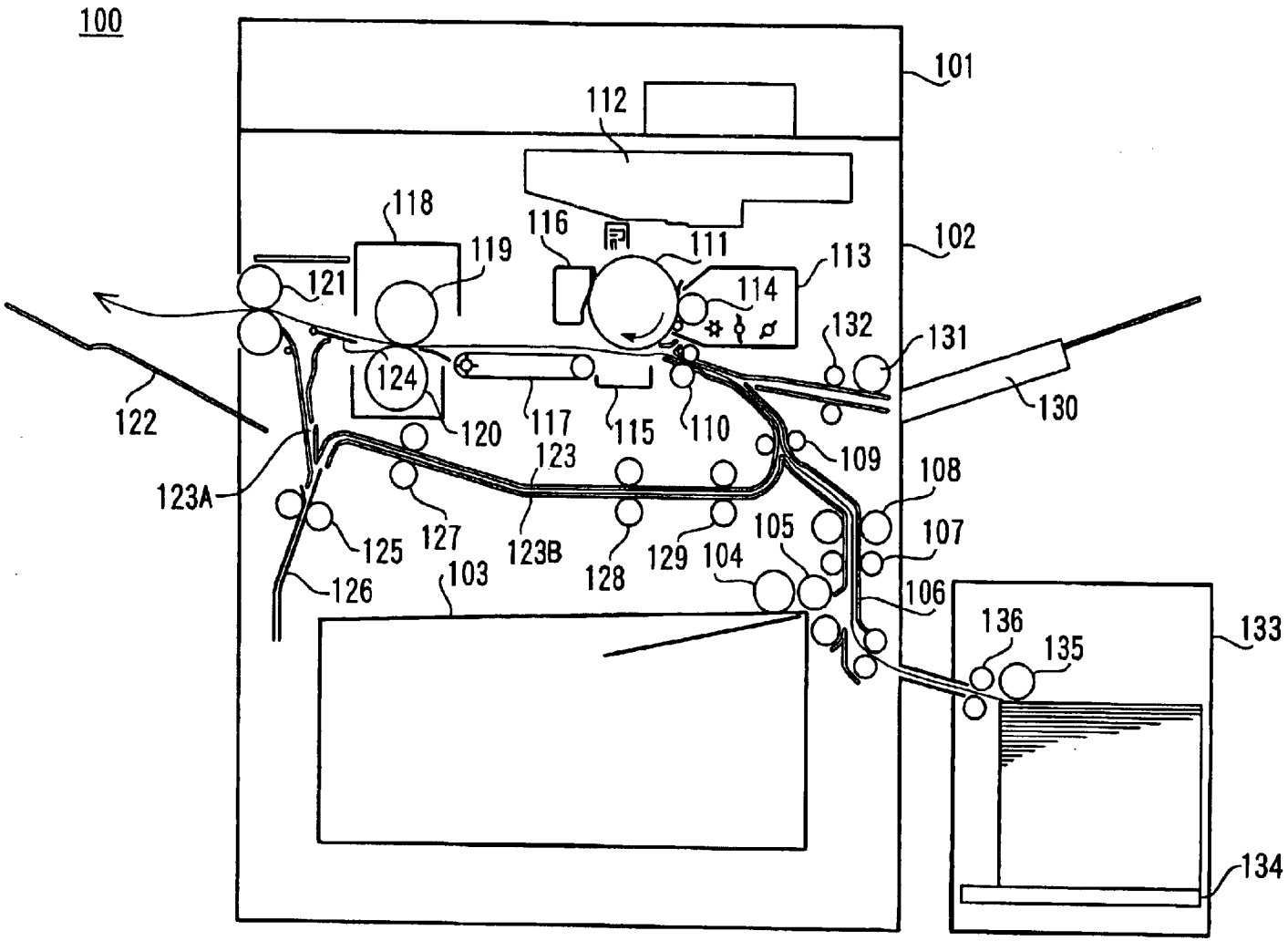
FIG. 1 is a schematic configuration illustrating a multifunctional printer according to an embodiment of the present invention.

FIG. 1 illustrates a schematic configuration of multifunctional printer 100 according to an embodiment of the present invention.

As shown in FIG. 1, multifunctional printer 100 includes scanning unit 101, in the upper area, that scans a document, and body unit 102, in the lower area, that performs paper feeding, transferring, recording, and fusing process.

An operation panel as a display is provided on the top surface of scanning unit 101. The operation panel is configured with an LED display, for example. The LED display displays the current status of multifunctional printer 100. The display on the operation panel is later described.

An open/close cover 802 (shown in FIG. 8) for exchanging a toner bottle and removing paper jam is provided on the front surface of body unit 102. When this cover is opened, the power supply to the drive mechanism (later described) within multifunctional printer 100 becomes shut down for safety.

Paper tray 103 as a paper container is provided at the bottom of body unit 102. Pickup roller 104 picks up the top sheet of paper loaded in paper tray 103.

When paper is picked up from paper tray 103, paper roller 105 sends the paper to paper path 106, which is formed upward from the bottom of body unit 102. Paper path 106 is provided with a plurality of midway rollers 107 and 108.

When the paper is delivered by the upward located midway roller 108, midway roller 109 passes the paper to registroller 110. Photoconductor drum 111 that rotates in the arrowed direction in the figure is positioned in the direction where the paper is delivered by registroller 110.

In the upper area of photoconductor drum 111, LSU (Laser Scan Unit) 112 that generates a latent image on the surface of photoconductor drum 111 is provided. Developing apparatus 113 that fuses toner to the latent image generated on photoconductor drum 111 is positioned adjacent to photoconductor drum 111. An agitation roller that agitates and delivers the developing solution, and development roller 114 that fuses the developing solution to photoconductor drum 111 are provided within developing apparatus 113.

Transfer unit 115 that transfers the image (generated when the developing solution is fused on photoconductor drum 111) on the delivered paper is provided in the lower area of photoconductor drum 111. Registroller 110 controls the positioning of the image on photoconductor drum 111 and paper recording area.

Cleaning unit 116 is located adjacent to photoconductor drum 111. Cleaning unit 116 cleans the surface of photoconductor drum 111 after it has transferred the image. The paper after the image transferring process is further delivered by delivery belt 117, to where fusing unit 118 is located.

Fusing unit 118 is provided with fusing roller 119, pressurizing roller 120 that is positioned opposing to fusing roller 119, and a cleaning roller (not shown) that applies oil to further the exfoliation of remaining toner on fusing toner 119. When fusing roller 118 applies heat on the recording surface of the paper and pressurizing roller 120 applies pressure to the paper against fusing roller 118, the image is fused on the paper.

When the paper is ejected from fusing unit 118, ejecting roller 121 ejects the paper outside of body unit 102. When the paper is ejected from body unit 102, finisher tray 122 receives the paper.

Switch guide 124 is positioned between fusing unit 118 and ejecting roller 121. Switch guide 124 switches the direction of the paper, between outside of body unit 102 for ejecting the paper and to duplex path 123 for duplex recording. Duplex path 123 is configured from proximity of switch guide 124 in the downward direction and is then shaped to roughly horizontal direction. Duplex path 123 includes duplex path 123A and duplex path 123B.

When the paper is sent to duplex path 123, reverse roller 125 first pulls the paper into reverse path 126, which is configured in the extension of part 123A (of duplex path 123) in the downward direction. When the paper is pulled into reverse path 126, reverse roller 125 spins in the reverse direction and sends the paper to part 123B (of duplex path 123) in the roughly horizontal direction, so that the surface of the paper is reversed (upside down).

When the paper is sent into duplex path 123B in the roughly horizontal direction, it is delivered by delivery rollers 127, 128, and 129 that are configured along duplex path 123B. Duplex path 123B is connected to paper path 106 below midway roller 109. When the paper is delivered through duplex path 123B via delivery rollers 127, 128, and 129, and sent into paper path 106, the paper is again sent under photoconductive drum 111, where image is generated on the backside of the paper.

Manual feed tray 130 is provided on a side of body unit 102. When a stack of paper is loaded on manual feed tray 130, the top sheet of paper is picked up by pickup roller 131 and delivered to registroller 110 by delivery roller 132.

Also, LCT (Large Capacity Tray) 133 is provided as an external paper tray, on a side of body unit 102. LCT 133 is used when image needs to be generated on a large amount of paper. LCT 133 is operated by a power supply from multifunctional printer 100.

When a large amount of paper is loaded, elevator 134 provided at the bottom of LCT 133 raises the top surface of paper to a predetermined position. When the top surface of the paper is raised to the predetermined position, pickup roller 135 picks up the paper. The paper retrieved from LCT 133 is then sent into paper path 106 by feeding roller 136.

Figure 2:
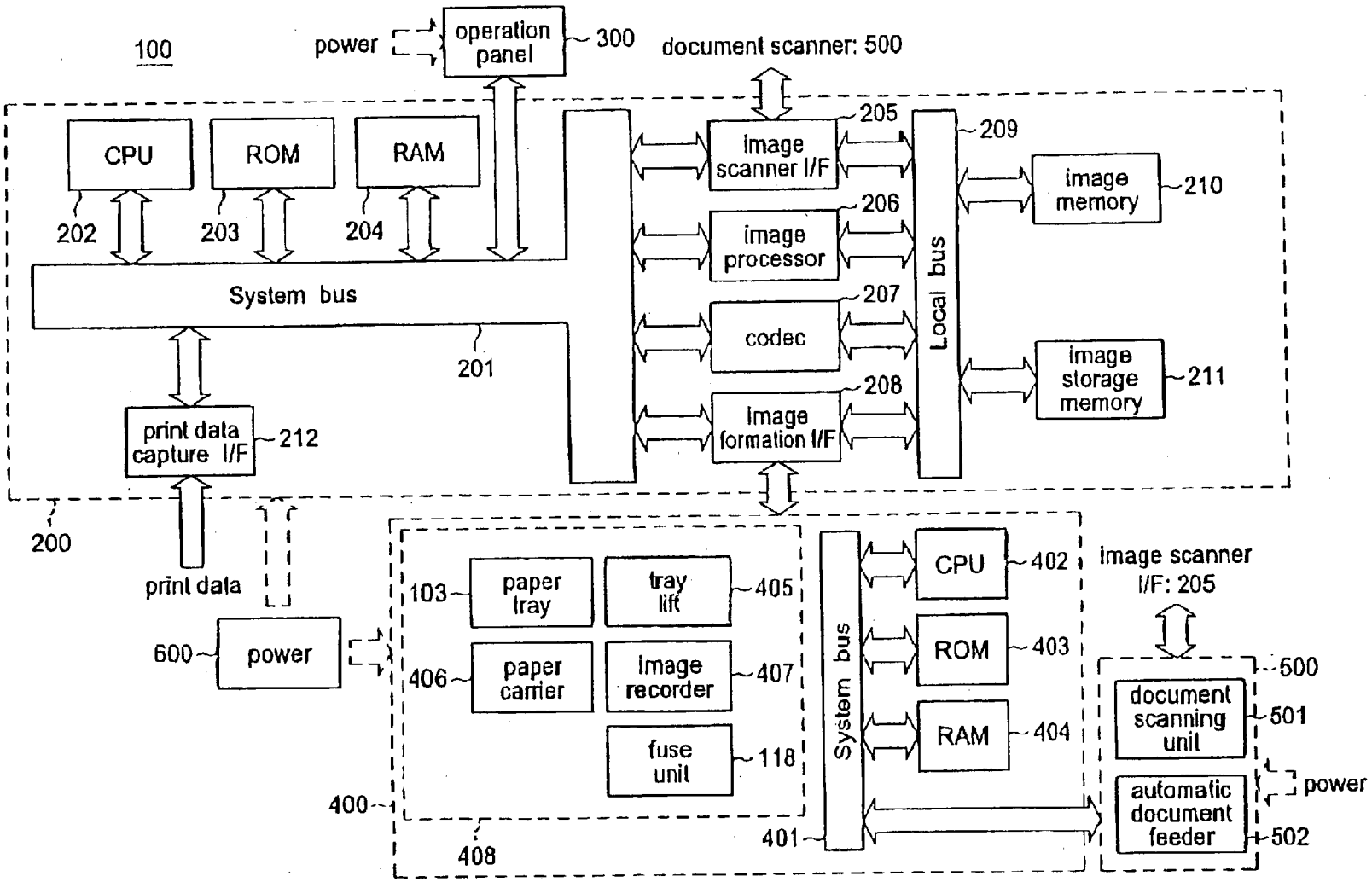
FIG. 2 is a functional block diagram illustrating the multifunctional printer according to the embodiment of the present invention.

FIG. 2 is a functional block diagram illustrating multifunctional printer 100 according to the present invention.

As shown in the figure, multifunctional printer 100 is provided with central processing apparatus 200 that controls the entire multifunctional printer 100, operation panel 300 that receives an instruction from a user and displays various information for the user, image generation unit 400 that generates an image on recording paper, document scanner 500 that scans the document, and power 600 that supplies power to the above mentioned functional units.

In central processing apparatus 200, ROM 203 and RAM 204 are connected to CPU 202 via system bus 201. The CPU 202 is configured as a part of the controller. ROM 203 is used as a storage area where CPU 202 stores a program for controlling the entire multifunctional printer 100. RAM 204 is used as a storage area for maintaining work area and the like of CPU 202.

Image scanner interface (I/F) 205, image processor 206, codec 207, and image formation I/F 208 are connected to system bus 201.

Image scanner I/F 205 connects document scanner 500 and system bus 201, and edits the scanned image data. Image processor 206 is an image processing circuit that enlarges/reduces the image data and rotates the data at an arbitrary degree. Codec 207 encodes/decodes image data. Image formation interface I/F 208 transfers the recorded image data from central processing apparatus 200 to image generation unit 400.

These image scanning I/F 205, image processor 206, codec 207, and image formation I/F 208 are connected to image memory 210 and image storage memory 211 via local bus 209.

Image memory 210 stores image data scanned by document scanner 500, while image storage memory 211 stores image data encoded by codec 207. These devices are connected via local bus 209, in order to provide a faster data transfer between the devices.

Print data capturer I/F 212 is also connected to system bus 201. Print data capturer I/F 212 retrieves print data generated by a data terminal apparatus, such as a PC.

In the image generation unit 400, ROM 403 and RAM 404 are connected to CPU 402 via system bus 401. The CPU 402 is configured as a part of the controller. ROM 403 is used as a storage area where CPU 402 stores a program for controlling image generation unit 400 and document scanner 500. RAM 404 is used as a storage area for maintaining work area and the like of CPU 402.

Image generation unit 400 is provided with paper tray 103, tray lift 405 that elevates the paper tray where a stack of paper is loaded within paper tray 103, paper carrier 406 that delivers the paper picked up from paper tray 103, image recorder 407 that records an image on the paper retrieved from paper tray 103, and fuse unit 118 that fuses the recorded image on the surface of the paper. All of these in the image generation unit 400 are controlled by CPU 402.

Tray lift 405 lifts the paper tray until the top sheet of the paper stack can be picked up by pickup roller 104. Paper carrier 406 delivers the paper by switching rollers empowered by drive motor as described below.

Image recorder 407 rotates photoconductive drum 111, while enabling LSU 112 to generate a latent image on photoconductive drum 111, and applying a predetermined voltage to transfer unit 115 to transfer the image on photoconductive drum 111 to the paper.

The above mentioned paper tray 103, tray lift 405, paper carrier 406, image recorder 407, and fuse unit 118 can be touched by the user when the cover is opened. Therefore, when the cover is opened, the drive for the same needs to be shut down. Accordingly, in multifunctional printer 100, the power supply to the above units is forcefully shut down, when the cover is opened.

In this embodiment, these paper tray 103, tray lift 405, paper carrier 406, image recorder 407, and fuse unit 118 are referred to as drive mechanism 408.

When multifunctional printer 100 has a paper delivery error, CPU 402 shuts down the power supply to drive mechanism 408 in advance, in consideration of a possibility of cover being opened. Therefore, the multifunctional printer 100 performs the above dual steps to ensure the safety.

The above-mentioned LCT 133 receives the power at the same time as drive mechanism 408. Accordingly, as soon as the power is shut down in drive mechanism 408, the power supply to LCT 133 is turned off.

Document scanner 500 includes document scanning unit 501 that scans the surface of a document set at scanning unit 101, and automatic document feeder 502 that delivers the document set at scanning unit 101. As shown in FIG. 2, since document scanner 500 is connected to CPU 402 via system bus 401, document scanning unit 501 and automatic document feeder 502 are controlled by CPU 402.

Figure 3:
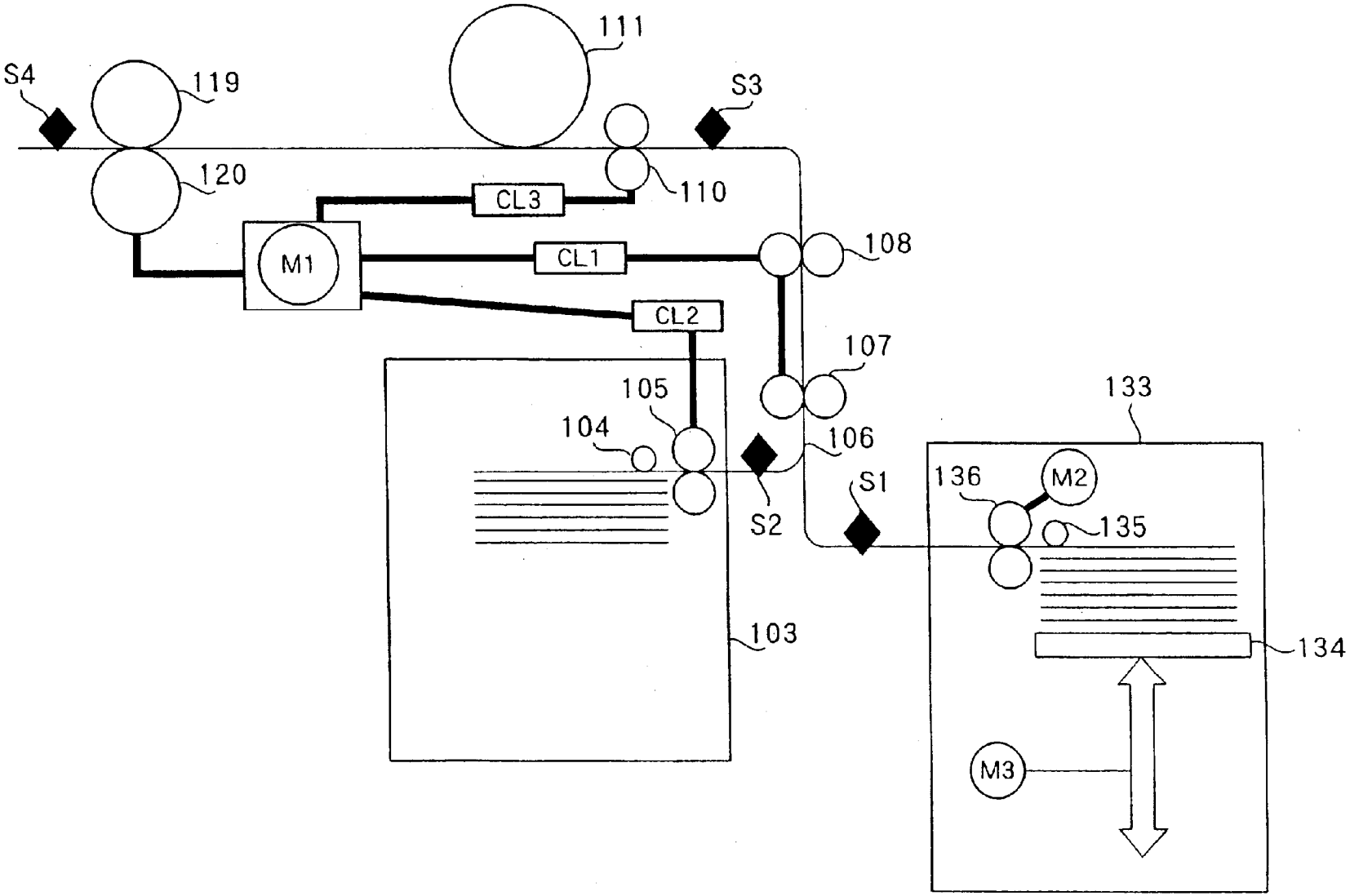
FIG. 3 is a schematic diagram illustrating a configuration for delivering a sheet of paper in the multifunctional printer according to the embodiment of the present invention.

Configuration for paper delivery in the above-described multifunctional printer 100 is illustrated as follows. FIG. 3 is a schematic diagram illustrating a configuration for paper delivery in multifunctional printer 100 according to the embodiment of the present invention. It is noted that the configuration for paper delivery is controlled by the above described paper carrier 406.

As shown in FIG. 3, multifunctional printer 100 includes drive motor 1 (M1) that drives a plurality of rollers located within body unit 102. To be specific, the first drive motor (M1) is connected to paper roller 105, midway rollers 107 and 108, registroller 110, and pressurizing roller 120.

The first drive motor (M1) is connected to midway rollers 107 and 108 via the first clutch (CL1), paper roller 105 via the second clutch (CL2), and registroller 110 via the third clutch (CL3). Under the control by paper carrier 406, the first, second, and third clutches (CL1–CL3) control the power transfer from the first drive motor (Ml) at a predetermined timing.

LCT 133 is provided with two drive motors: the second drive motor (M2) driving feeding roller 136; and the third drive motor (M3) driving elevator 134. As described above, the second and third drive motors (M2–M3) rotates by receiving the power supply from the body of multifunctional printer 100.

A plurality of first-fourth sensors are located on a path for the paper delivery in multifunctional printer 100. These first-fourth sensors detect paper delivery error (paper jam), by detecting the paper passage.

To be specific, the first sensor (S1) is located at a midway position where the paper retrieved from LCT 133 is sent to paper path 106. The second sensor (S2) is located at a midway position where the paper retrieved from paper tray 103 is sent in by paper path 106.

The third sensor (S3) is positioned at proximity of registroller 110 on paper path 106, and is located at the upstream of the paper delivery direction. The fourth sensor (S4) is positioned at proximity of fusing unit 118, and is located at the downstream of the paper delivery direction.

Figure 4:
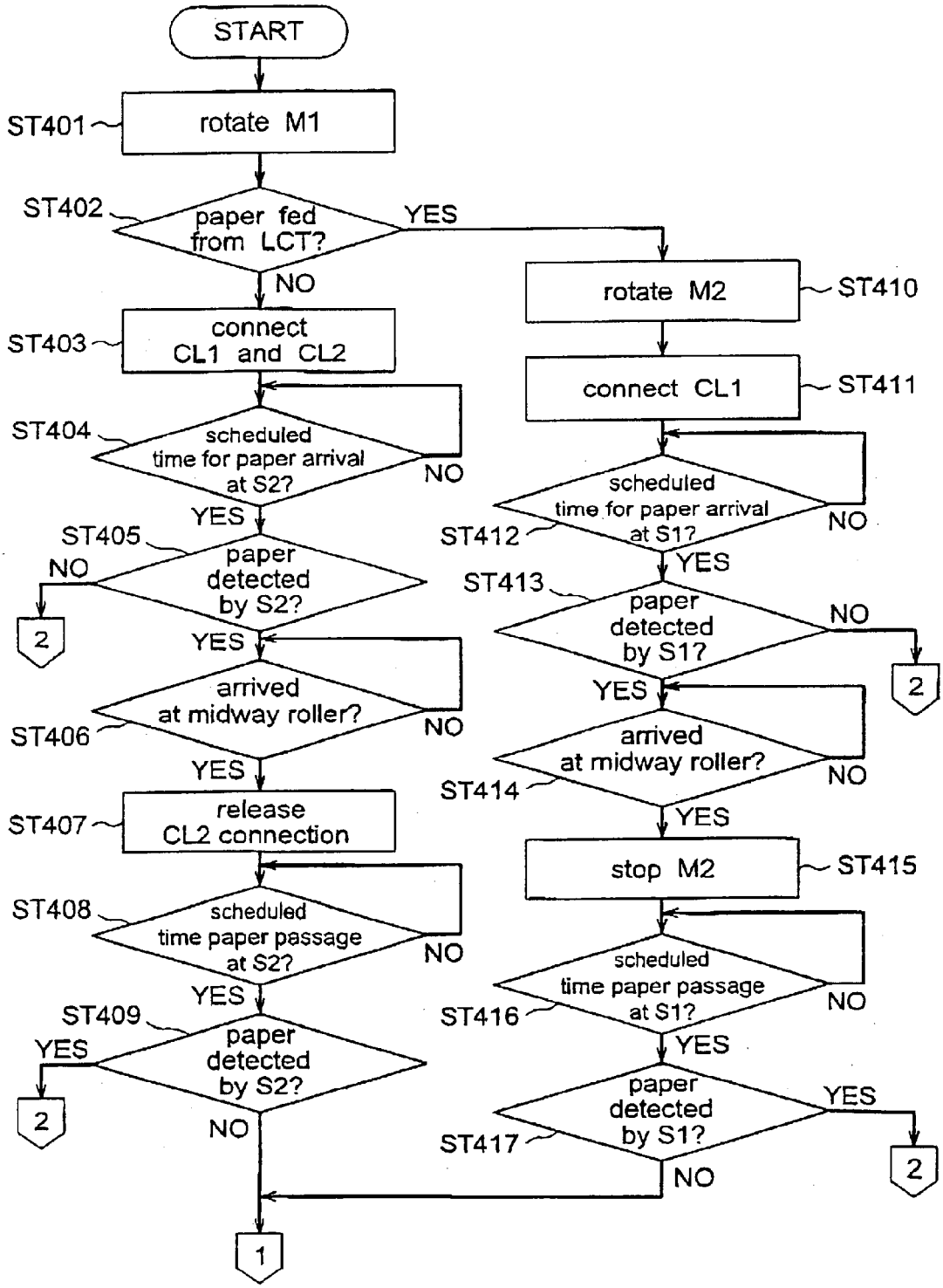
FIG. 4 is a flowchart illustrating a paper feeding operation in the multifunctional printer according to the embodiment of the present invention.
Figure 5:
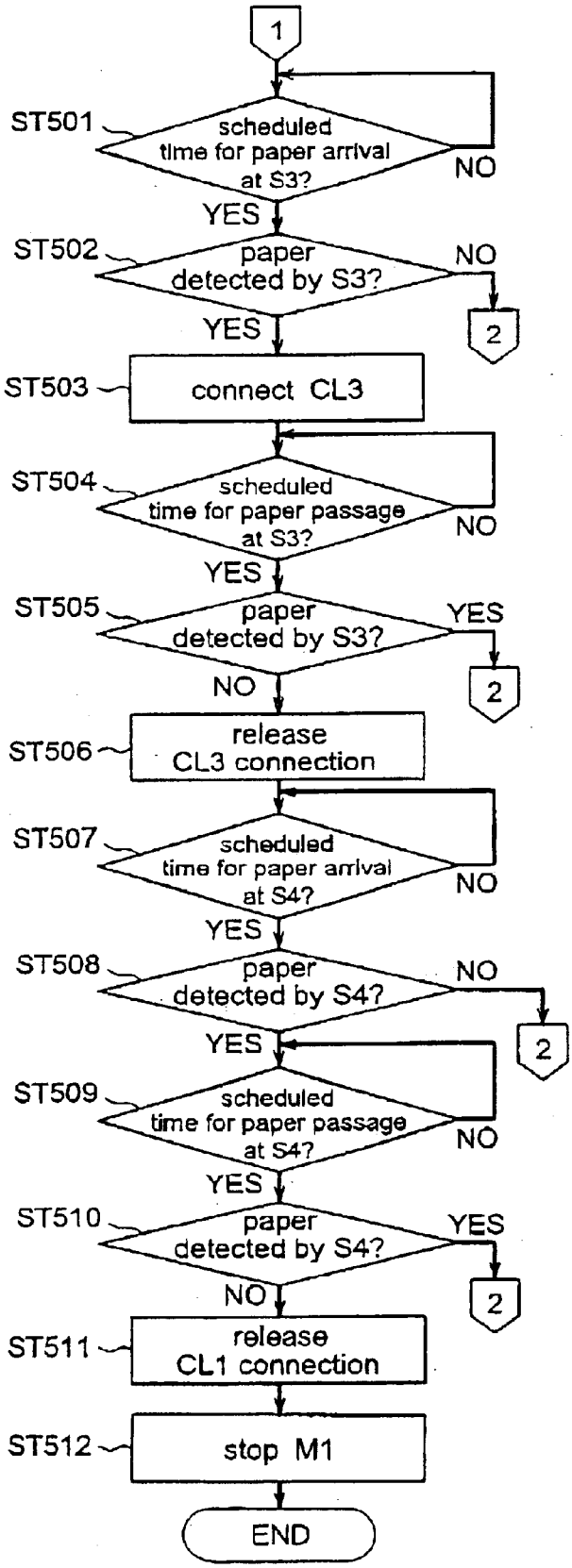
FIG. 5 is a flowchart illustrating a paper feeding operation in the multifunctional printer according to the embodiment of the present invention.
Figure 6:
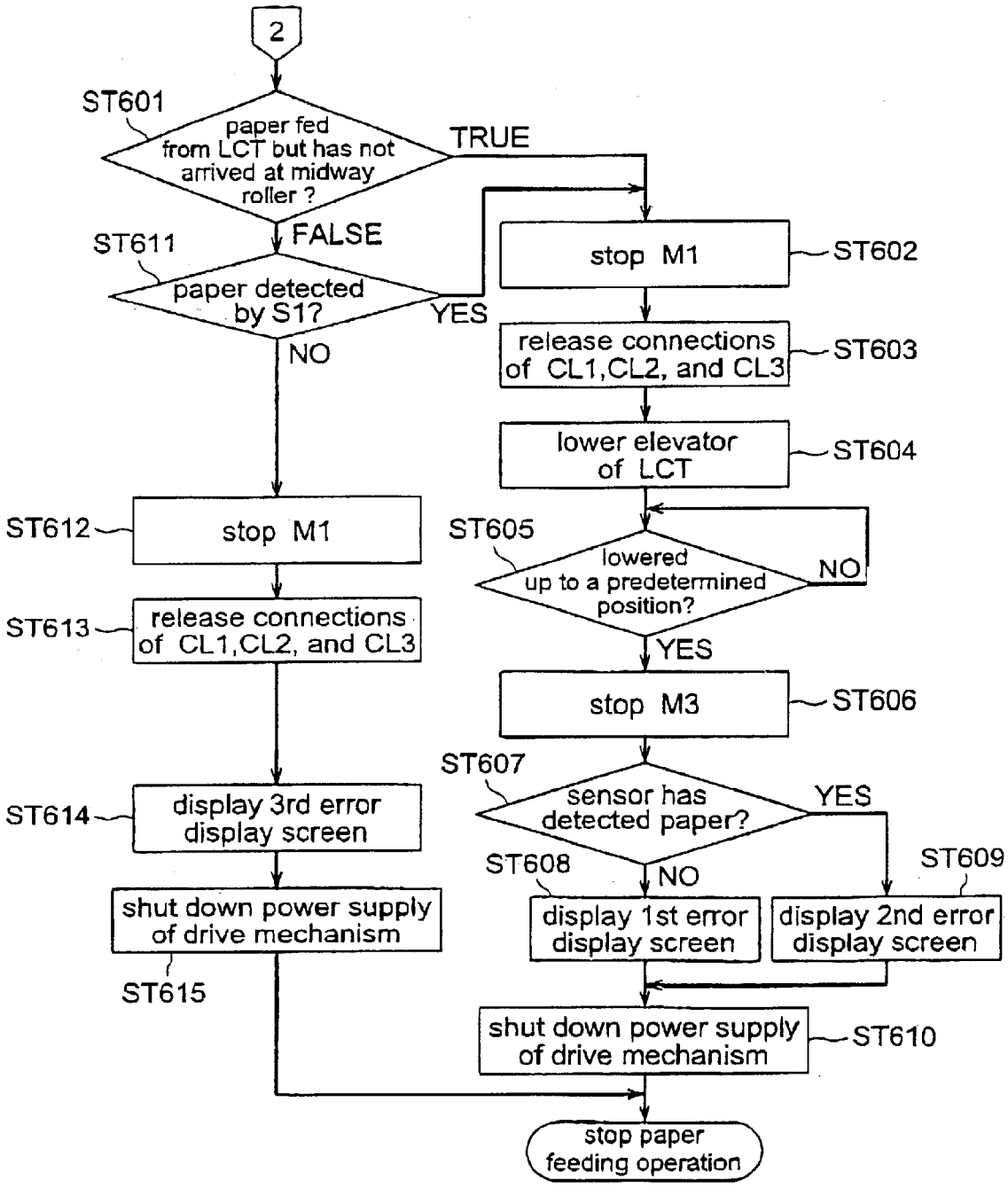
FIG. 6 is a flowchart illustrating a paper feeding operation in the multifunctional printer according to the embodiment of the present invention.

A paper feeding operation in multifunctional printer 100 of the above-described configuration is illustrated below. FIGS. 4–6 are flowcharts illustrating the paper feeding operation in multifunctional printer 100 according to the embodiment of the present invention.

Figure 7:
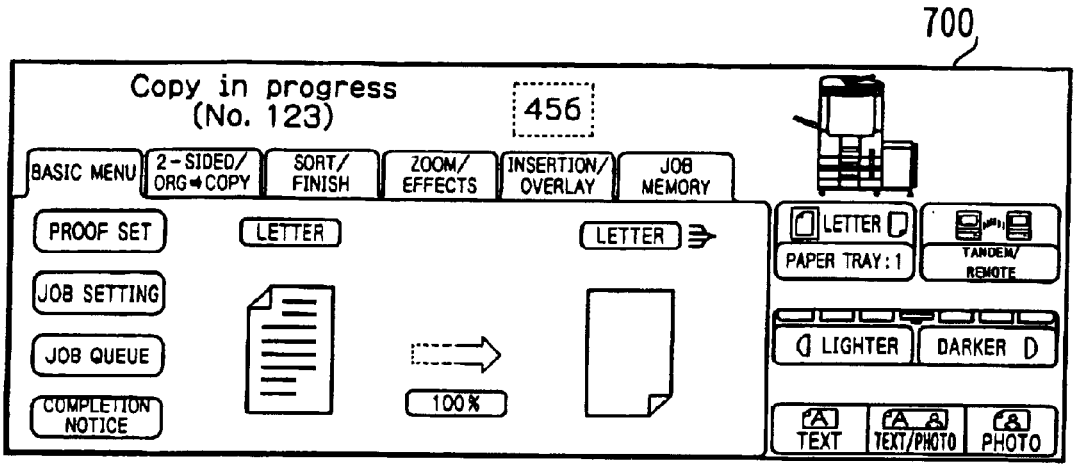
FIG. 7 illustrates an example of a display screen on an operation panel in the multifunctional printer according to the embodiment of the present invention.

When the user instructs multifunctional printer 100 for a process such as image recording, status display screen 700 shown in FIG. 7 is displayed on operation panel 300. As shown in FIG. 7, status display screen 700 displays a current status of multifunctional printer 100, and instructed image recording process.

When the paper feeding is started, multifunctional printer 100 first rotates the first drive motor (M1) (ST401), and determines whether the paper is fed from LCT 133 (ST402).

When the paper is not fed from LCT 133, i.e., when the paper is fed from paper tray 103, the first and second clutches (CL1 and CL2) are connected (ST403). Then, multifunctional printer 100 monitors a predetermined time for the paper retrieved from paper tray 103 to reach the second sensor (S2) (hereafter referred to as "S2 paper arrival scheduled time") (ST404). "S2 paper arrival scheduled time" is counted from when the first and second clutches (CL1 and CL2) are connected at ST403.

When "S2 paper arrival scheduled time" expires, it is checked whether the second sensor (S2) has detected the paper (ST405). This is to check for any delivery error with the paper fed from paper tray 103 not having arrived at the second sensor (S2). When the second sensor (S2) detects the paper, it is checked whether the tip of the paper has arrived at midway roller 107 (ST406). The determination is made based on whether a predetermined time has passed for the tip of the paper to arrive at midway roller 107 since the second sensor (S2) is turned on.

When the tip of the paper has already arrived at midway roller 107, the connection of the second clutch (CL2) is released (ST407). Then, multifunctional printer 100 monitors a predetermined time for the end of the paper retrieved from paper tray 103 to pass the second sensor (S2) (hereafter referred to as "S2 paper passage scheduled time") (ST408). "S2 paper passage scheduled time" is counted since the second clutch (CL2) detected the paper.

When "S2 paper passage scheduled time" expires, it is checked whether the second sensor (S2) detects the paper (ST409). This is to check for any delivery error with the paper having not delivered from where the second sensor (S2) is located. When the second sensor (S2) does not detect the paper, it means that the end of the paper has passed the second sensor (S2). Therefore, the process control of multifunctional printer 100 is moved to ST501.

When the second sensor (S2) does not detect the paper at ST405, or when the second sensor (S2) detects the paper at ST409, the process control of multifunctional printer 100 is moved to ST601.

When it is determined that the paper is fed from LCT 133 at ST402, the second drive motor (M2) is rotated (ST410). After the first clutch (CL1) is connected (ST411), multifunctional printer 100 monitors a predetermined time for the tip of the paper retrieved from LCT 133 to reach the first sensor (S1) (hereafter referred to as "S1 paper arrival scheduled time") (ST412). "S1 paper arrival scheduled time" is counted from the connection of the first clutch (CL1) at ST411.

When "S1 paper arrival scheduled time" expires, it is checked whether the first sensor (S1) has detected the paper (ST413). This is to check for any delivery error with the paper fed from LCT 133 having not arrived at the first sensor (S1). When the first sensor (S1) has detected the paper, it is checked whether the tip of the paper has arrived at midway roller 107 (ST414). The determination is made based on whether a predetermined time has passed for the tip of the paper to arrive at midway roller 107 since the first sensor (S1) is turned on.

When the tip of the paper has already arrived at midway roller 107, the rotation of the second drive motor (M2) is stopped (ST415). Then, multifunctional printer 100 monitors a predetermined time for the end of the paper retrieved from LCT 133 to pass the first sensor (S1) (hereafter referred to as "S1 paper passage scheduled time") (ST416). "S1 paper passage scheduled time" is counted since the first sensor (S1) detected the paper.

When "S1 paper passage scheduled time" expires, it is checked whether the first sensor (S1) detects the paper (ST417). This is to check for any delivery error with the paper having not delivered from where the first sensor (S1) is located. When the first sensor (S1) does not detect the paper, it means that the end of the paper has passed the first sensor (S1). Therefore, the process control of multifunctional printer 100 is moved to ST501.

When the first sensor (S1) does not detect the paper at ST413, or when the first sensor (S1) detects the paper at ST417, the process control of multifunctional printer 100 is moved to ST601.

At ST501, multifunctional printer 100 monitors a predetermined time for the end of the paper (after passing first or second sensor S1 or S2) to reach the third sensor (S3) (hereafter referred to as "S3 paper arrival scheduled time"). "S3 paper arrival scheduled time" is counted since the paper arrives at midway roller 107.

When "S3 paper arrival scheduled time" has expired, it is determined whether the third sensor (S3) has detected the paper (ST502). This is to check for any delivery error with the paper (after passing the first or second sensor S1 or S2) having not reached at the third sensor (S3).

When the third sensor (S3) has detected the paper, the third clutch (CL3) is connected (ST503). Then, multifunctional printer 100 monitors a predetermined time for the end of the paper (after passing first or second sensor S1 or S2) to pass the third sensor (S3) (hereafter referred to as "S3 paper passage scheduled time") (ST504). "S3 paper passage scheduled time" is counted since the third clutch (CL3) is connected at ST503.

When "S3 paper passage scheduled time" is expired, it is checked whether the third sensor (S3) detects the paper (ST505). This is to check for any delivery error with the paper having not delivered from where the third sensor (S3) is located.

When the third sensor (S3) does not detect the paper, it means the end of the paper has passed the third sensor (S3). Therefore, the connection of the third clutch (CL3) is cancelled (ST506). Then, multifunctional printer 100 monitors a predetermined time for the tip of the paper (after passing the third sensor S3) to reach the fourth sensor (S4) (hereafter referred to as "S4 paper arrival scheduled time") (ST507). "S4 paper arrival scheduled time" is counted since the third clutch (CL3) is connected at ST503.

When "S4 paper arrival scheduled time" is expired, it is checked whether the fourth sensor (S4) detects the paper (ST508). This is to check for any delivery error with the paper having not delivered from where the fourth sensor (S4) is located.

When the fourth sensor (S4) has detected the paper, multifunctional printer 100 monitors a predetermined time for the end of the paper to pass the fourth sensor (S4) (hereafter referred to as "S4 paper passage scheduled time") (ST509). "S4 paper passage scheduled time" is counted since the third clutch (CL3) is connected at ST503.

When "S4 paper passage scheduled time" is expired, it is checked whether the fourth sensor (S4) detects the paper (ST510). This is to check for any delivery error with the paper having not delivered from where the fourth sensor (S4) is located. When the fourth sensor (S4) does not detect the paper, it means that the paper is normally ejected.

When the fourth sensor (S4) does not detect the paper, it means that the end of the paper has passed the fourth sensor (S4). Therefore, the connection of the first clutch (CL1) is cancelled (ST511). Then, the rotation of the first drive motor (M1) is stopped (ST512), and the series of the paper feeding operation of multifunctional printer 100 is completed.

When the third sensor (S3) does not detect the paper at ST502, when the third sensor (S3) detects the paper at ST505, when the fourth sensor (S4) does not detect the paper at ST508, or when the fourth sensor (S4) detects the paper at ST510, the control process of multifunctional printer 100 is moved to ST601.

At ST601, multifunctional printer 100 checks whether it is true that the paper fed from LCT 133 has not arrived at midway roller 107. In particular, it is checked whether it is true that the first sensor (S11) has not detected the paper at ST413 ("NO" at ST413).

When the paper fed from LCT 133 has not arrived at midway roller 107, the rotation of the first drive motor (M1) is stopped (ST602), and the connections of all clutches (CL1, CL2, and CL3) are released (ST603).

When the connections of all clutches are released, multifunctional printer 100 lowers elevator 134 of LCT 133 (ST604). To be specific, the third drive motor (M3) is rotated in order to lower elevator 134 of LCT 133.

Then, it is checked whether elevator 134 has been lowered to a predetermined location (ST605). In this embodiment, the predetermined location is set where an enough space can be provided for the user's hand to reach between the inner top wall of LCT 133 and the top sheet of paper loaded on elevator 134. When elevator 134 is lowered to the predetermined position, the rotation of the third drive motor (M3) is stopped (ST606).

When the third drive motor (M3) is stopped, multifunctional printer 100 checks whether other sensors have detected the paper (ST607). In this stage, the first sensor (S1) has not detected the paper at ST413. Therefore, other sensors (S2, S3, or S4) are checked whether they have detected the paper.

In particular, when the paper remains within LCT 133 during the paper delivery error, it can be that the paper fed from LCT 133 has first caused the paper delivery error, or that the paper delivered before has caused the paper delivery errors, leaving the following paper within the LCT 133. Therefore, it is determined which case it is at ST607.

When the answer is "TRUE" at ST601, it is determined that the first paper fed from LCT 133 is causing the paper delivery error, remaining in LCT 133. Therefore, other sensors cannot have detected the paper at ST607.

When other sensors have not detected the paper, multifunctional printer 100 determines that the paper delivery error is caused only at LCT 133. Then, error display screen 800 corresponding to the paper delivery error (hereafter referred to as "the first error display screen") is displayed on operation panel 300 (ST608).

Figure 8:
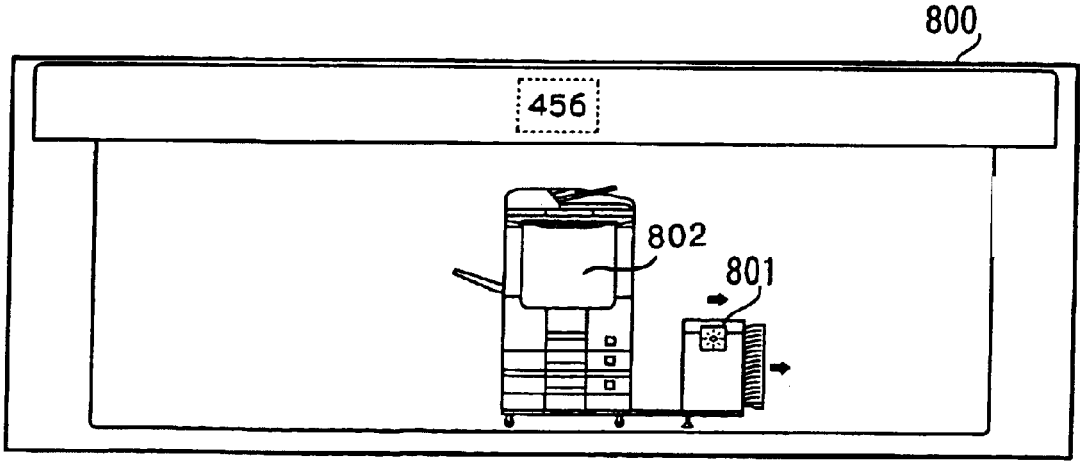
FIG. 8 illustrates a first error display screen on the operation panel in the multifunctional printer according to the embodiment of the present invention.

Accordingly, operation panel 300 switches the display screen 700 shown in FIG. 7 to the first error display screen 800 of FIG. 8. As shown in FIG. 8, the first error display screen 800 displays an image of multifunctional printer 100. The first error display screen 800 displays error mark 801 illustrating the paper delivery error at a location corresponding to LCT 133. When the user views the first error display screen 800, the user can recognize where the paper delivery error has occurred.

When the paper is detected by the other sensor(s), multifunctional printer 100 recognizes that there are a plurality of paper delivery error. Then, error display screen 900 corresponding to this paper delivery error (hereafter referred to as "the second error display screen") is displayed on operation panel 300 (ST609).

In other words, when the answer is "FALSE" at ST601 and the answer is "YES" at ST611, there are two possible situations. The first situation would be that the first sheet of paper fed from LCT 133 has not passed the first sensor (S1) and remains within LCT 133. The second situation would be that the paper following the first (from LCT 133) has not passed the first sensor (S1) and remains within LCT 133. In case of the first situation, the first error display screen 800 is selected at ST608 to be displayed. In case of the second situation, there is a possibility that the previously delivered paper has not passed the other sensor(s), thereby causing a paper delivery error. Accordingly, when other sensor has detected the paper at ST607, the second error display screen 900 is selected at ST609 to be displayed. The process at ST611 is later described.

Figure 9:
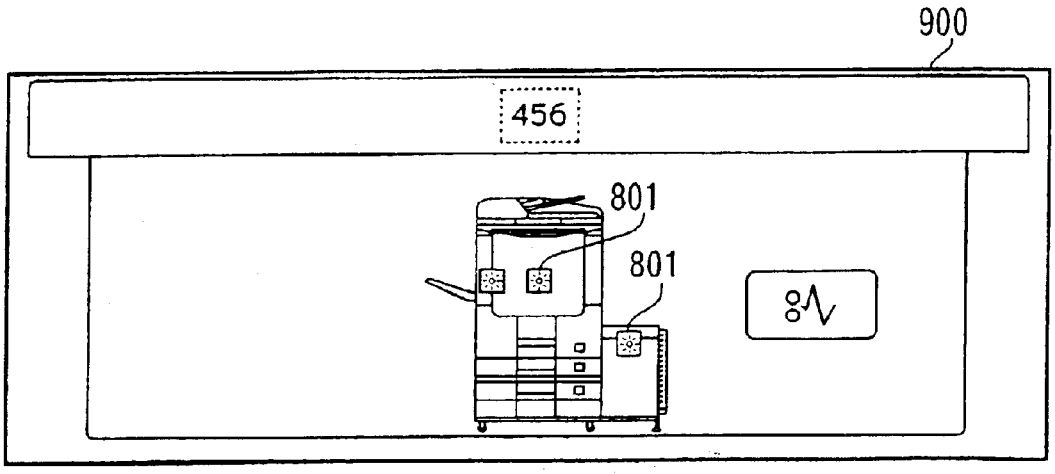
FIG. 9 illustrates a second error display screen on the operation panel in the multifunctional printer according to the embodiment of the present invention.
Figure 10:
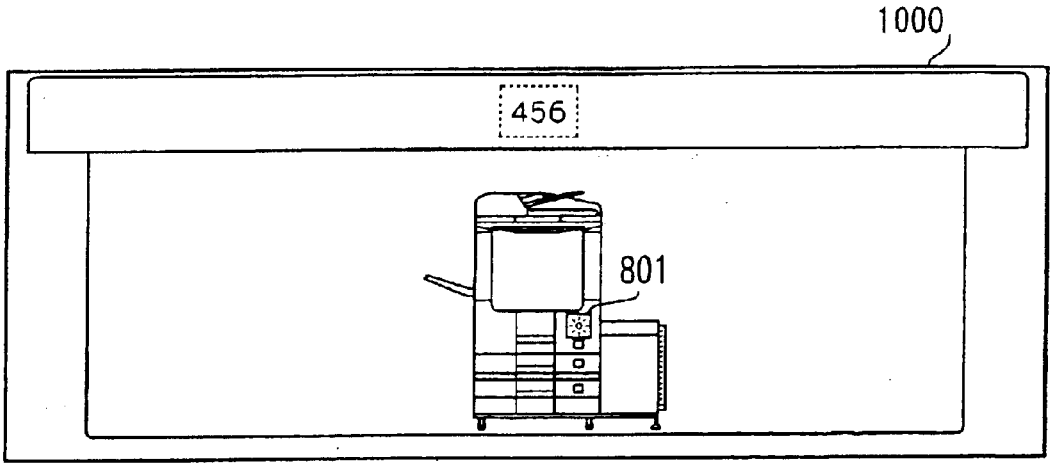
FIG. 10 illustrates a third error display screen on the operation panel in the multifunctional printer according to the embodiment of the present invention.

Accordingly, operation panel 300 switches display screen 700 of FIG. 7 to the second error display screen 900 of FIG. 9. Similar to the first error display screen 800, the second error display screen 900 includes error marks 801 indicating where the paper delivery errors have occurred. Since there are a plurality of paper delivery errors at the second error display screen 900, a plurality of error marks 801 are displayed in FIG. 9.

When any one of error display screens is displayed, multifunctional printer 100 shuts off the power supply to drive mechanism 408 (ST610), and interrupts the paper feeding operation. When the user resolves the paper delivery error and inputs an instruction again, the process is restarted from ST401.

When it is determined that the determination made at ST413 was that S1 has detected the paper ("YES" at ST413), multifunctional printer 100 checks whether the first sensor (S1) has detected the paper (ST611). In other words, it is checked whether the first sensor (S1) has detected the paper at ST417 ("YES" at ST417).

When the first sensor (S1) has detected the sensor, multifunctional printer 100 moves the process control to ST602 and performs the above-described process up to ST610. This is in particular, that even when the first sensor (S1) detects the tip of the paper (ST413), and when a predetermined time scheduled for the tip of the paper to pass midway roller 107 (ST416), the paper delivery error has occurred while the first sensor (S1) continues to detect the paper. There are two possible cases in this situation as described above. Accordingly, it is checked whether there are other sensors detecting the paper at ST607. When such sensor is found, the second error display screen 900 is selected to be displayed at ST609. When such sensor is not found, the first error display screen 800 is selected to be displayed at ST608.

When the process control is moved to ST602 from the determination made at ST601 and ST611, multifunctional printer 100 recognizes that the paper display error has occurred at LCT 133.

On the other hand, when the first sensor (S1) has not detected the paper at ST611, multifunctional printer 100 stops the rotation of the first drive motor (M1) (ST612), and releases the connections of the first, second, and third clutches (CL1, CL2, and CL3) (ST613).

In this case, multifunctional printer 100 recognizes that the paper delivery error has occurred only within body unit 102. Immediately after the rotation of the first drive motor (M1) is stopped, error display screen 1000 corresponding to the paper delivery error (hereafter referred to as "the third error display screen") is displayed on operation panel 300 (ST614).

Accordingly, operation panel 300 switches the display screen 700 shown in FIG. 7 to the first display screen 800 of FIG. 8. As shown in FIG. 8, the first error display screen 800 displays an image of multifunctional printer 100. The first error display screen 800 displays error mark 801 illustrating the paper delivery error at a location corresponding to LCT 133. When the user views the first error display screen 800, the user can recognize where the paper delivery error has occurred. The open/close cover 802 is also shown on the display screen 800.

When the third error display screen 1000 is displayed, multifunctional printer 100 shuts off the power supply for drive mechanism 408 (ST615) and interrupts the paper feeding operation, similar to the process of ST610. When the user resolves the paper delivery error and re-inputs the instruction, the process restarts from ST401.

According to multifunctional printer 100 of the present embodiment, when paper remains within LCT 133 in case of a paper delivery error, elevator 134 is lowered to a predetermined position before the power supply for drive mechanism 408 is shut down. Therefore, it is possible to provide safety and to provide a space necessary to remove the paper jam by lowering the elevator at the same time. Since the user can reach between an inner top wall of LCT 133 and the top sheet of paper loaded on the elevator, paper jam can be removed easily.

In addition, when multifunctional printer 100 has the paper delivery error and the paper only remains within body unit 102, the power supply to drive mechanism 408 is immediately shut down. Therefore, even when LCT 133 is attached, it is possible to provide the same safety as in a case where LCT 133 is not attached, because the power supply to drive mechanism 408 is shut down without delay.

Especially, when multifunctional printer 100 has the paper delivery error within paper tray 103, the power supply to drive mechanism 408 is shut down at the time of the error. Accordingly, when the paper delivery error occurred within LCT 133, the power supply for drive mechanism 408 is shut immediately after elevator 134 is lowered to a predetermined position, while securing the safety and providing the space necessary to remove the paper jam. Thus, it is possible to simplify the paper jam retrieval while securing safety, no matter whether the delivery error is caused by the paper from paper tray 103 or LCT 133.

Furthermore, multifunctional printer 100 is provided with operation panel 300 that displays an error message in case of a paper delivery error. Operation panel displays an error message when elevator 134 is lowered to a predetermined position in case the paper is within LCT 133. Thus, the user does not know about the error from operation panel 300 until elevator 134 is lowered to the predetermined position. Therefore, it is possible to prevent a situation that the user would mistakenly open the cover, which shuts down the power supply to drive mechanism 408, before elevator 134 is lowered to a predetermined position. As a result, it is possible to prevent a situation where elevator 134 is halted without being lowered and where an enough space for paper jam removal is not provided within LCT 133, which makes it difficult to remove the paper jam.

In addition, when the paper delivery error only occurred in body unit 102, multifunctional printer 100 displays an error message on operation panel 300 at the time of error. Since the error is informed via operation panel 300 immediately after the error, it is possible to prevent the delay in informing the error even with LCT 133 being attached.

Especially, multifunctional printer 100 displays the error message on operation panel as soon as the paper delivery error occurs within paper tray 103. Since the error is immediately informed via operation panel 300, it is possible to prevent the delay in informing the error even with LCT 133 being attached.

Further, multifunctional printer 100 sets the predetermined position for lowering elevator 134 so that enough space is provided for the user's hand to reach between the inner top wall of LCT 133 and the top sheet of paper loaded on elevator 134. Therefore, even when a paper delivery error has occurred within LCT 133, enough space is provided for paper jam removal within LCT 133. Thus, it is possible to easily remove the paper jam.

Additionally, since elevator 134 is stopped at a location where enough space for user's hand. Thus, it is possible to save time to re-raise elevator 134 after removing the paper jam, so that the top paper loaded on elevator 134 reaches the feeding position.

The explanation of the embodiment has been done using multifunctional printer 100. However, the present invention can be applied to any apparatuses that include an external paper tray, corresponding to LCT 133 (e.g., copier).

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above-described embodiments, and various variations and modifications may be possible without departing from the scope of the present invention.

This application is based on the Japanese Patent Application No. 2002-064117 filed on Mar. 8, 2002, entire content of which is expressly incorporated by reference herein.

What is claimed is:

1. A multifunctional printer comprising:

an external paper tray that supplies paper to the multifunctional printer, said external paper tray having an elevator that moves up and down in relation to the multifunctional printer and is empowered by a power supplier supplying electrical power to a drive mechanism of the multifunctional printer, the paper being loaded on the elevator; and a controller that first lowers said external paper tray to a predetermined position and then shuts off the power supplied to the drive mechanism of the multifunctional printer, when a sheet of paper remains in said external paper tray during a paper delivery error.

2. The multifunctional printer according to claim 1, wherein said controller shuts off the power supplied to the drive mechanism of the multifunctional printer, without lowering said external paper tray, when a sheet of paper does not remain in said external paper tray during a paper delivery error.

3. The multifunctional printer according to claim 1, further comprising:

a paper tray that is internally installed to the multifunctional printer and supplies paper to the multifunctional printer.

4. The multifunctional printer according to claim 3, wherein said controller shuts off the power supplied to the drive mechanism of the multifunctional printer, when a paper delivery error is occurred within said paper tray.

5. The multifunctional printer according to claim 3, further comprising:

a display that displays an error message when a paper delivery error is occurred;

wherein said controller enables said display to display the error message immediately when the paper delivery error is occurred within said paper tray, while said controller enables said display to display the error message after said external paper tray is lowered to the predetermined position when the paper delivery error is occurred within said external paper tray.

6. The multifunctional printer according to claim 1, further comprising:

an open/close cover that exposes a recording unit within the multifunctional printer, wherein said controller shuts off the power supplied to the drive mechanism of the multifunctional printer, when said open/close cover is opened.

7. The multifunctional printer according to claim 1, further comprising:

a display that displays an error message when a paper delivery error is occurred within said external paper tray.

8. The multifunctional printer according to claim 7, wherein said controller enables said display to display the error message after said external paper tray is lowered to the predetermined position.

9. The multifunctional printer according to claim 1, further comprising:

a display that displays an error message when a paper delivery error is occurred;

wherein said controller enables said display to display the error message immediately when the paper delivery error is occurred at outside of said external paper tray, while said controller enables said display to display the error message after said external paper tray is lowered to the predetermined position when the paper delivery error is occurred within said external paper tray.

10. A method for a multifunctional printer comprising:

supplying paper to the multifunctional printer by an external paper tray having an elevator that moves up and down in relation to the multifunctional printer and is empowered by a power supplier supplying electrical power to a drive mechanism of the multifunctional printer, the paper being loaded on the elevator; and first lowering said external paper tray to a predetermined position and then shutting off the power supplied to the drive mechanism of the multifunctional printer, when a sheet of paper remains in the external paper tray during a paper delivery error.

11. The method for the multifunctional printer according to claim 10, wherein the power supplied to the drive mechanism of the multifunctional printer is shut off, without lowering said external paper tray, when a sheet of paper does not remain in the external paper tray during a paper delivery error.

12. A copier comprising:

an external paper tray that supplies paper to the copier, said external paper tray having an elevator that moves up and down in relation to the copier and is empowered by a power supplier supplying electrical power to a drive mechanism of the copier, the paper being loaded on the elevator; and a controller that first lowers said external paper tray to a predetermined position and then shuts off the power supplied to the drive mechanism of the copier, when a sheet of paper remains in said external paper tray during a paper delivery error.

* * * * *